US009371212B2

(12) United States Patent
Yapar

(10) Patent No.: US 9,371,212 B2
(45) Date of Patent: Jun. 21, 2016

(54) ELEVATOR SYSTEM INCLUDING A 4:1 ROPING ARRANGEMENT

(75) Inventor: Cemal Selcuk Yapar, Istanbul (TR)

(73) Assignee: Otis Elevator Company, Farmington, CT (US)

( * ) Notice: Subject to any disclaimer, the term of this patent is extended or adjusted under 35 U.S.C. 154(b) by 161 days.

(21) Appl. No.: 14/009,416

(22) PCT Filed: Apr. 6, 2011

(86) PCT No.: PCT/US2011/031420
§ 371 (c)(1),
(2), (4) Date: Oct. 2, 2013

(87) PCT Pub. No.: WO2012/138335
PCT Pub. Date: Oct. 11, 2012

(65) Prior Publication Data
US 2014/0027207 A1 Jan. 30, 2014

(51) Int. Cl.
*B66B 11/08* (2006.01)
*B66B 11/00* (2006.01)
*B66B 11/02* (2006.01)

(52) U.S. Cl.
CPC ..... *B66B 11/08* (2013.01); *B66B 11/008* (2013.01); *B66B 11/0206* (2013.01)

(58) Field of Classification Search
CPC .... B66B 11/08; B66B 11/008; B66B 11/0206
USPC ..... 187/266
See application file for complete search history.

(56) References Cited

U.S. PATENT DOCUMENTS

| | | | | |
|---|---|---|---|---|
| 3,101,130 | A * | 8/1963 | Giuseppe Bianca Edoardo | 187/244 |
| 6,345,695 | B1 | 2/2002 | Fargo et al. | |
| 6,364,061 | B2 * | 4/2002 | Baranda et al. | 187/254 |
| 6,471,012 | B2 | 10/2002 | Faletto | |
| 6,598,707 | B2 * | 7/2003 | Nakagaki et al. | 187/256 |
| 6,655,500 | B2 | 12/2003 | Orrman et al. | |
| 7,117,977 | B2 | 10/2006 | Abe | |
| 7,225,901 | B2 | 6/2007 | Mustalahti et al. | |

(Continued)

FOREIGN PATENT DOCUMENTS

| | | | |
|---|---|---|---|
| EP | 1754680 | A1 | 2/2007 |
| EP | 1768923 | B1 | 10/2008 |

(Continued)

OTHER PUBLICATIONS

State Intellectual Property Officer of People's Republic China, First Search Report for Application No. 201180069895.9 dated Jan. 3, 2015.

(Continued)

*Primary Examiner* — Michael Riegelman
(74) *Attorney, Agent, or Firm* — Carlson, Gaskey & Olds

(57) ABSTRACT

An exemplary elevator system includes an elevator car. A plurality of belts are situated relative to the elevator car such that movement of the belts for causing movement of the elevator car is approximately four times a corresponding movement of the elevator car. First, second, third and fourth sheaves are supported for vertical movement with the elevator car and rotational movement relative to the elevator car. Each belt has a portion extending across the elevator car between the first and second sheaves that is vertically aligned with another portion of the same belt extending across the elevator car between the third and fourth sheaves.

18 Claims, 7 Drawing Sheets

(56) References Cited

U.S. PATENT DOCUMENTS

| | | | | |
|---|---|---|---|---|
| 7,267,200 | B2 | 9/2007 | Orrman | |
| 7,549,514 | B2 | 6/2009 | Heggli et al. | |
| 7,806,238 | B2 | 10/2010 | Fischer | |
| 7,878,306 | B2 | 2/2011 | Siewert et al. | |
| 2002/0000348 | A1 | 1/2002 | Faletto | |
| 2004/0108170 | A1* | 6/2004 | Kocher et al. | 187/254 |
| 2004/0216958 | A1* | 11/2004 | Ach | 187/254 |
| 2005/0217943 | A1 | 10/2005 | Heggli et al. | |
| 2006/0249337 | A1 | 11/2006 | McNamara et al. | |
| 2007/0137946 | A1 | 6/2007 | Aulanko et al. | |
| 2007/0227832 | A1 | 10/2007 | Aulanko et al. | |
| 2008/0121468 | A1 | 5/2008 | Fischer | |
| 2010/0126808 | A1 | 5/2010 | Hashiguchi | |
| 2012/0006626 | A1* | 1/2012 | Adifon | 187/249 |

FOREIGN PATENT DOCUMENTS

| | | | | |
|---|---|---|---|---|
| EP | 1616833 | B1 | 2/2010 | |
| EP | 1641698 | B1 | 8/2010 | |
| JP | 35-5563 | | 5/1935 | |
| JP | 11-246145 | | 9/1999 | |
| WO | 9943593 | | 9/1999 | |
| WO | 2003086937 | | 10/2003 | |
| WO | 2004108576 | | 12/2004 | |
| WO | 2005000728 | A1 | 1/2005 | |
| WO | WO 2010126497 | A1 * | 11/2010 | B66B 11/00 |

OTHER PUBLICATIONS

International Search Report and Written Opinion of the International Searching Authority for International application No. PCT/US2011/031420 dated Apr. 17, 2012.

Buga Otis—Field Installation Manual—New Cargo Line, Chapter 5, p. 1/6, Apr. 2007, TRBA25GV1, Revision: 1.

International Preliminary Report on Patentability for International application No. PCT/US2011/031420 dated Oct. 17, 2013.

Extended European Search Report for Application No. EP 1 86 3243 dated Aug. 1, 2014.

* cited by examiner

ELEVATOR SYSTEM INCLUDING A 4:1 ROPING ARRANGEMENT

BACKGROUND

Noon Elevator systems have proven useful for carrying passengers between different levels in buildings. A variety of different elevator system configurations are available. Traction-based elevator systems include a roping arrangement that supports the weight of the elevator car and a counterweight. A machine drives a traction sheave that causes movement of the roping members to cause desired movement of the elevator car.

Various roping arrangements are known in the industry. The most straightforward is considered a 1:1 roping arrangement in which the movement of the roping members and the corresponding amount of movement of the elevator car is the same. In a 2:1 roping arrangement the roping members movement is twice as much as the corresponding movement of the elevator car. 4:1 roping arrangements have been proposed and include roping member movement that is approximately four times as much as the corresponding movement of the elevator car.

With the introduction of flat belt suspension members in place of round steel ropes, the ability to realize different roping arrangements is more complicated. For example, flat belts introduce belt tracking and twisting issues. The United States Patent Application Publication No. US 2008/0121468 shows one possible 4:1 roping arrangement that includes flat belts as the roping members. That document proposes a system configuration that includes a stacked arrangement of deflection sheaves on one side of the hoistway. One disadvantage associated with such an arrangement is that it requires more vertical space within the hoistway to accommodate the arrangement of those sheaves. Minimizing the amount of hoistway space required for an elevator system is an ongoing challenge within the elevator industry.

SUMMARY

An exemplary elevator system includes an elevator car. A plurality of belts are situated relative to the elevator car such that movement of the belts for causing movement of the elevator car is approximately four times a corresponding movement of the elevator car. First, second, third and fourth sheaves are supported for vertical movement with the elevator car and rotational movement relative to the elevator car. Each belt has a portion extending across the elevator car between the first and second sheaves that is vertically aligned with another portion of the same belt extending across the elevator car between the third and fourth sheaves.

In one example embodiment that includes the elements of the foregoing elevator system, the first and second sheaves are spaced from each other a first horizontal distance and the third and fourth sheaves are spaced from each other a second, smaller horizontal distance.

In another example embodiment that includes the elements of any of the foregoing elevator system embodiments, the first and second sheaves rotate about respective axes that are both in a first horizontal plane. The third and fourth sheaves rotate about respective axes that are both in a second horizontal plane. The first plane is beneath the second horizontal plane.

In another example embodiment that includes the elements of any of the foregoing elevator system embodiments, the first, second, third and fourth sheaves are all supported beneath the elevator car.

In another example embodiment including the elements of any of the foregoing elevator system embodiments, the first, second, third and fourth sheaves are all supported above the elevator car.

In another example embodiment including the elements of any of the foregoing elevator system embodiments, the elevator system includes an idler sheave in a fixed vertical position above the elevator car. The plurality of belts follow a path that includes extending downward toward the first sheave, wrapping underneath the first sheave, extending across the elevator car between the first and second sheave, wrapping underneath the second sheave, extending upward from the second sheave, wrapping over the idler sheave, extending downward towards the third sheave, wrapping underneath the third sheave, extending across the elevator car between the third and fourth sheaves, wrapping underneath the fourth sheave and extending upward from the fourth sheave.

In another example embodiment including the elements of any of the foregoing elevator system embodiments, the elevator car has a front wall including at least one door. Each of the belts has a thickness, a width that is greater than the thickness and a length that is greater than the width. Each of the belts has a traction surface defining the width and the length of the belt. The traction surface of every belt is substantially aligned with the traction surface of every other belt. All of the traction surfaces are substantially parallel with a plane that is generally perpendicular to the front wall of the elevator car along the entire length of every belt.

In another example embodiment including the elements of the elevator system embodiment of the previous paragraph, the elevator car includes first and second side walls that are each transverse to the front wall. The traction surface of every belt is generally parallel to the side walls along every vertically oriented portion of every belt.

In another example embodiment including the elements of any of the foregoing elevator system embodiments, the system includes a first cassette supporting the first and second sheaves near opposite ends of the first cassette with a first horizontal spacing between the first and second sheaves. A second cassette supports the third and fourth sheaves near the opposite ends of the second cassette with a second, smaller horizontal spacing between the third and fourth sheaves. The first cassette is positioned beneath the second cassette.

In another example embodiment including the elements of any of the foregoing elevator system embodiments, the elevator car includes a front wall having at least one door and first and second side walls transverse to the front wall. The first and fourth sheaves are positioned near the first side wall. The second and third sheaves are positioned near the second side wall.

In another example embodiment including the elements of the elevator system embodiment of the previous paragraph, each of the sheaves includes a plurality of belt guiding surfaces. The belt guiding surface on the first sheave engaged by a first one of the belts is vertically offset with the belt guiding surface on the fourth sheave engaged by the first one of the belts. The belt guiding surface on the second sheave engaged by the first one of the belts is vertically offset with the belt guiding surface on the third sheave engaged by the first one of the belts.

In another example embodiment including the elements of the elevator system embodiments of either of the preceding two paragraphs, the belt guiding surface for each of the belts on the first sheave is vertically offset with the corresponding belt guiding surface for the same one of the belts on the fourth sheave. The belt guiding surface for each of the belts on the second sheave is vertically offset with the corresponding belt guiding surface for the same one of the belts on the third sheave.

In another example embodiment including the elements of any of the foregoing elevator system embodiments, each sheave includes a divider between adjacent belt guiding surfaces on the sheave. The divider on the first sheave is vertically offset with the divider on the fourth sheave. The divider on the second sheave is vertically offset with the divider on the third sheave.

In another example embodiment including the elements of any of the foregoing elevator system embodiments, vertically oriented portions of the belts extending upward from the first and second sheaves are horizontally spaced apart a first distance that is larger than a width of the elevator car. Vertically oriented portions of the belts extending upward from the third and fourth sheaves are horizontally spaced apart a second distance that is larger than a width of the elevator car and smaller than the first distance.

In another example embodiment including the elements of any of the foregoing elevator system embodiments, the system includes a traction sheave and a plurality of idler sheaves. The traction sheave, the idler sheaves, the first sheave, the second sheave, the third sheave and the fourth sheave each rotate about a respective axis. All of the sheave axes are substantially parallel.

In another example embodiment including the elements of the elevator system embodiment of the previous paragraph, at least one of the idler sheaves is on a first side of the elevator car and the traction sheave is on a second, opposite side of the elevator car.

Another exemplary elevator system includes an elevator car. A plurality of belts are situated relative to the elevator car such that movement of the belts for causing movement of the elevator car is approximately four times a corresponding movement of the elevator car. A first sheave, a second sheave, a third sheave and a fourth sheave are all supported for vertical movement with the elevator car and rotational movement relative to the elevator car. A traction sheave causes movement of the belts. The system includes a plurality of idler sheaves. The traction sheave, the idler sheaves, the first sheave, the second sheave, the third sheave and the fourth sheave each rotate about a respective axis and all of the sheave axes are substantially parallel.

In another example embodiment that includes the features of any of the foregoing elevator system embodiments, each belt has a portion extending across the elevator car between the first and second sheaves that is vertically aligned with another portion of the same belt extending across the elevator car between the third and fourth sheaves.

In another example embodiment that includes the features of any of the foregoing elevator system embodiments, the elevator car has a front wall including at least one door. Each of the belts has a thickness, a width that is greater than the thickness and a length that is greater than the width. Each of the belts has a traction surface defining the width and the length of the belt. The traction surface of every belt is aligned with the traction surface of every other belt along corresponding portions of the belts. All of the traction surfaces are substantially parallel with a plane that is generally perpendicular to the front wall of the elevator car along the entire length of every belt.

The various features and advantages of disclosed example embodiments will become apparent to those skilled in the art from the following detailed description. The drawings that accompany the detailed description can be briefly described as follows.

DETAILED DESCRIPTION

Figure 1:
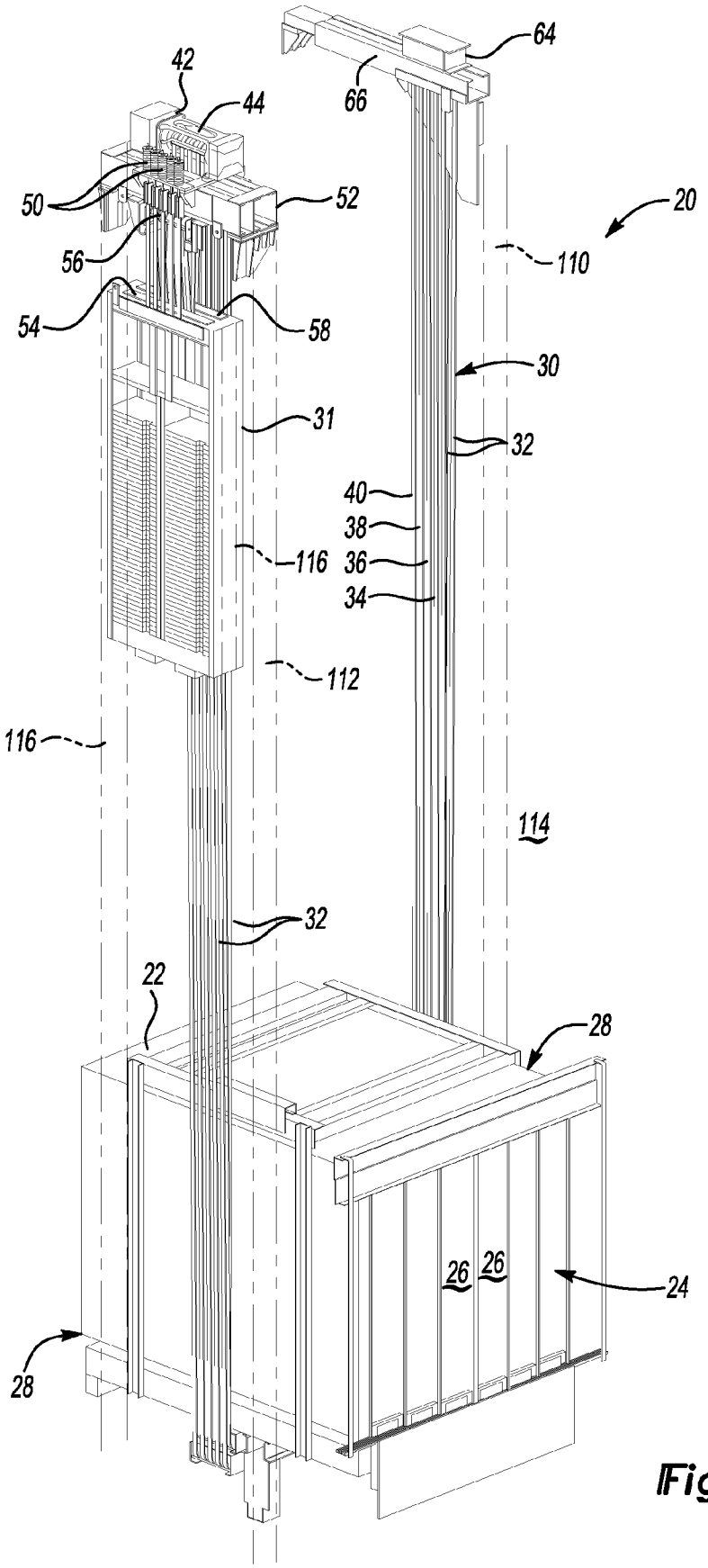
FIG. 1 diagrammatically illustrates selected portions of an elevator system including a roping arrangement designed according to an embodiment of this invention.
Figure 7:
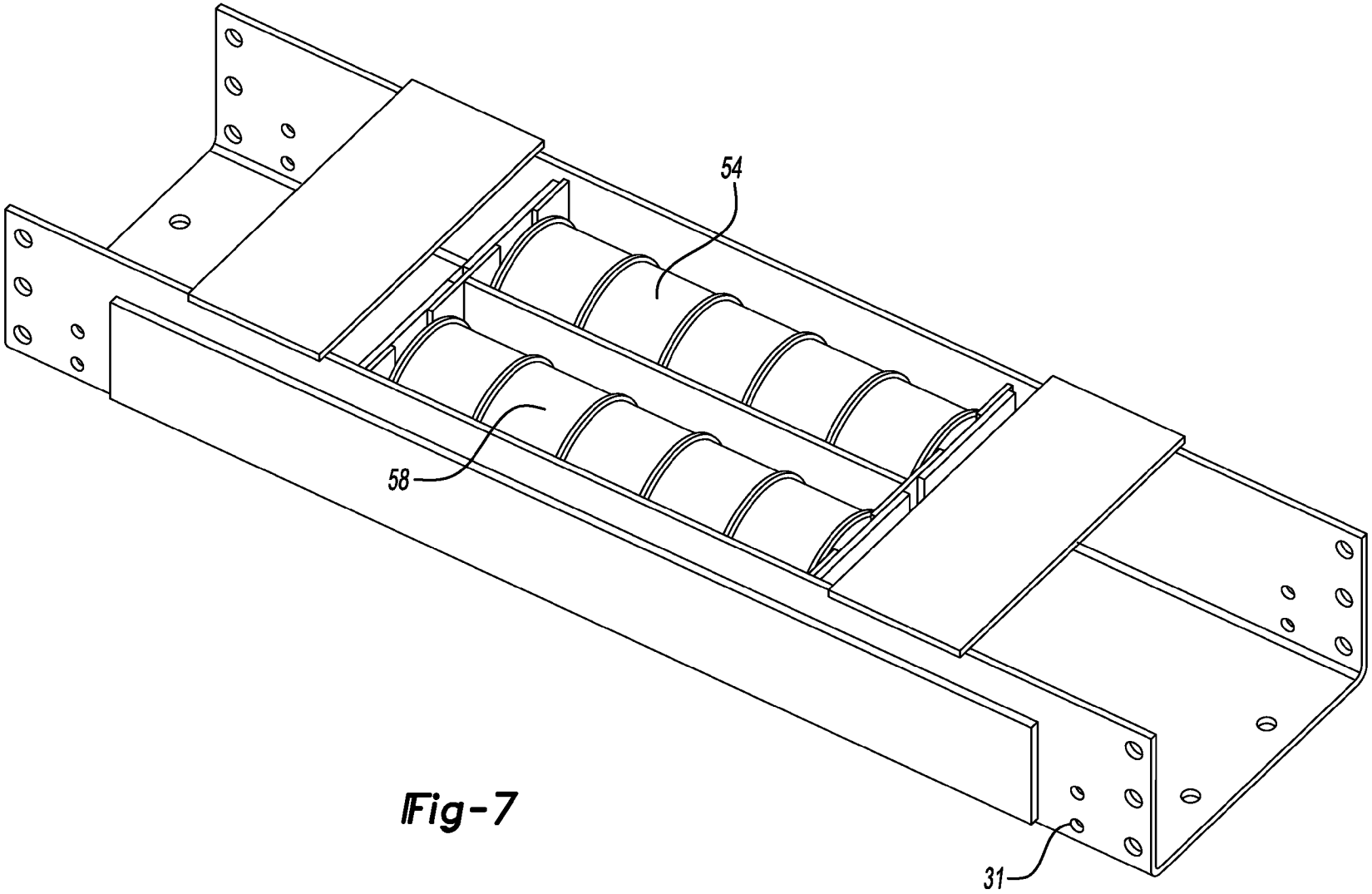
FIG. 7 diagrammatically illustrates a topside of a counterweight frame that can be employed by either of the embodiments shown in FIGS. 2 and 6 of this invention.

FIG. 1 illustrates selected portions of an elevator system 20. An elevator car 22 includes a front wall 24 that has at least one door 26 to allow passengers to enter or exit the elevator car 22. Side walls 28 are on opposite sides of the elevator car 22. The side walls 28 are generally perpendicular to the front wall 24. The car 22 is configured to move vertically through a hoistway 114 along guide rails 110, 112, which are shown schematically in FIG. 2 (and one of which is shown in FIG. 7).

Figure 8:
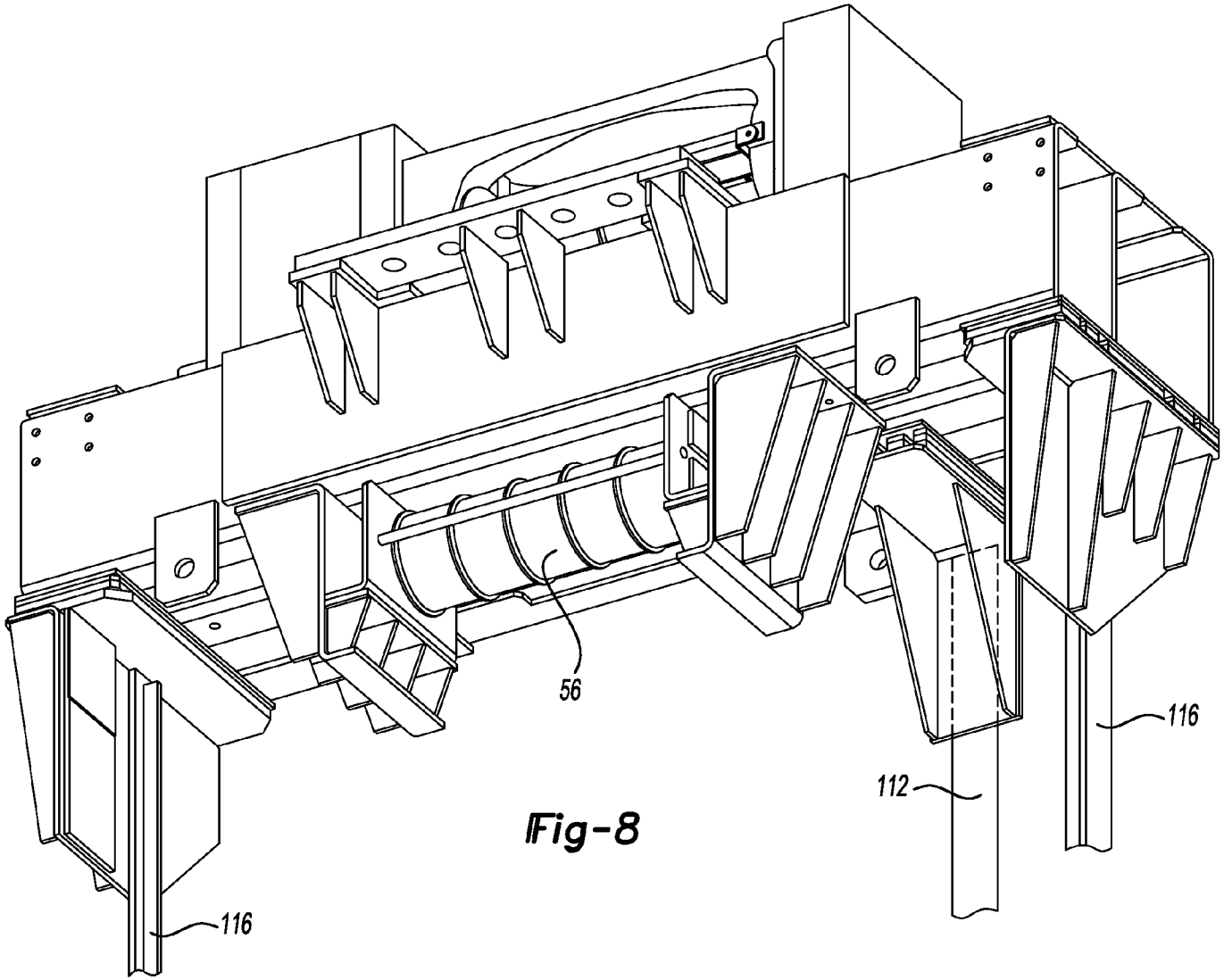
FIG. 8 diagrammatically illustrates an underside of a machine bedplate that can be employed by either of the embodiments shown in FIGS. 2 and 6 of this invention.

The roping arrangement 30 suspends the elevator car 22 and an associated counterweight 31, which is configured to move vertically through the hoistway along counterweight guide rails 116 (shown in FIG. 8). In this example, the roping arrangement 30 comprises a plurality of belts 32, 34, 36, 38 and 40. In other embodiments a different number of belts may be used. A motor 42 and traction sheave 44 cause desired movement of the belts 32-40 to cause desired movement of the elevator car 22 to provide elevator service to passengers, for example.

The roping arrangement 30 is in a 4:1 configuration so that movement of the belts 32-40 for causing movement of the elevator car 22 is approximately four times the amount of resulting movement of the elevator car 22. The 4:1 roping configuration can be appreciated by considering FIGS. 1 and 2.

A plurality of terminations 50 secure one end of each of the belts 32-40. The terminations 50 are secured in a fixed vertical position within the hoistway on a bed plate structure 52 in this example. The bedplate 52 may, as shown in FIG. 8, be supported by one of the car guide rails 112 and both of the counterweight guide rails 116. In other embodiments, however, the bedplate may be supported by the front, side, and/or rear walls of the hoistway 114.

The belts 32-40 follow a path extending from the terminations 50 downward toward a first idler sheave 54 that is supported for vertical movement with the counterweight 31 and rotational movement relative to the counterweight 31. The belts wrap beneath the first idler sheave 54 and extend upward toward another idler sheave 56 supported by the bed plate 52. The belts wrap over the idler sheave 56 and extend downward toward a second idler sheave 58 supported by the counterweight 31. The belts wrap beneath the second idler sheave 58 and then extend upward toward the traction sheave 44. The first and second idler sheaves 54, 58 are shown in FIG. 7 whereas the idler sheave 56 is shown in FIG. 8.

In the illustrated example, the idler sheave 58 is mounted on the counterweight 31. In another example, however, the idler sheave 58 may be supported in a fixed location in the hoistway, for example on the bed plate 52, in the pit, or elsewhere in the hoistway. Placement of the idler sheave 58 will depend on the particular configuration of a given elevator system.

After the belts 32-40 wrap over the traction sheave 44, they extend downward toward a first sheave 60 supported for vertical movement with the elevator car 22. The first sheave 60 is also supported for rotational movement relative to the elevator car 22. The belts wrap beneath the first sheave 60 and then extend across the elevator car 22 between the first sheave 60 and a second sheave 62 that is also supported for vertical movement with the elevator car 22 and rotational movement relative to the elevator car 22. The belts then wrap beneath the second sheave 62 and extend upward toward another idler sheave 64 that is positioned in a fixed vertical location above the elevator car 22. The idler sheave 64 in this example is supported by a mounting bracket 66 near a top of a hoistway, for example. The mounting bracket 66 may be, as shown in FIG. 1, supported by a car guide rail 110. In other embodiments, the mounting bracket may additionally or alternatively be mounted to the front, side, and/or rear walls of the hoistway 114.

The belts 32-40 wrap over the idler sheave 64 and extend downward toward a third sheave 68 supported for vertical movement with the elevator car 22. The belts wrap beneath the third sheave 68 and then extend across the elevator car 22 between the third sheave 68 and a fourth sheave 70 that is also supported for vertical movement with the elevator car 22. The belts 32-40 wrap beneath the fourth sheave 70 then extend upward toward a plurality of terminations 72 that secure an opposite end of the belts in a fixed vertical position above the elevator car 22. Although the terminations 72 are supported on the bed plate 52 in the illustrated example, the terminations may be secured in any fixed location; for example the terminations may be mounted to a ceiling of the hoistway or by a bracket similar to mounting bracket 66.

Figure 2:
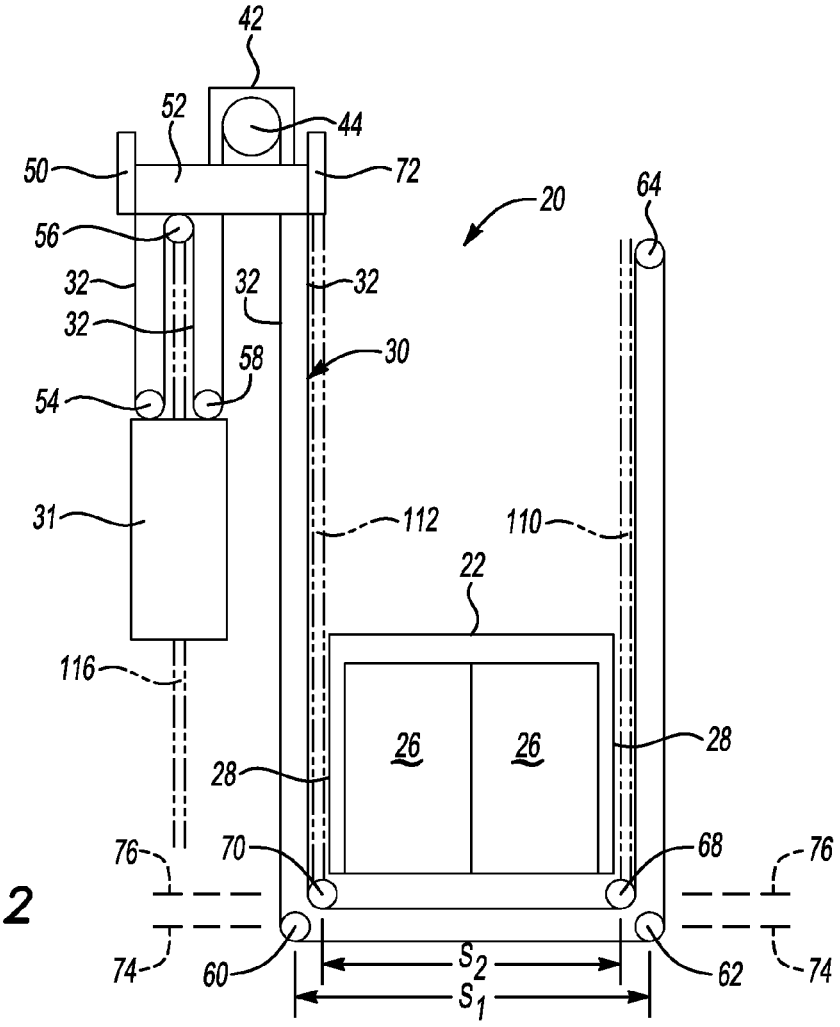
FIG. 2 schematically illustrates a path followed by belts in the roping arrangement of the example of FIG. 1.

As can be appreciated from FIG. 2, the first sheave 60 and the second sheave 62 are supported beneath the elevator car 22 with a first horizontal spacing $S_1$ between them. The third sheave 68 and the fourth sheave 70 are also supported beneath the elevator car 22 with a second horizontal spacing $S_2$ between them. The first sheave 60 is further from the second sheave 62 than the third sheave 68 is from the fourth sheave 70. In other words, the spacing $S_1$ is greater than the spacing $S_2$. This arrangement of the sheaves 60, 62, 68 and 70 allows the belts to follow the path schematically shown in FIG. 2.

The first sheave 60 and the second sheave 62 are horizontally aligned with each other with their axes of rotation in a single horizontal plane 74. The third sheave 68 and the fourth sheave 70 are aligned with each other with their respective axes of rotation in a single horizontal plane 76. As can be appreciated from the drawing, the plane 74 is beneath the plane 76. In this configuration, the second sheave 62 is at least partially vertically beneath the third sheave 68. Similarly, the first sheave 60 is at least partially vertically beneath the fourth sheave 70. With the illustrated configuration, the vertically extending portions of the belts that engage the third sheave 68 and the fourth sheave 70 are closer to the side walls 28 of the elevator car 22 compared to the portions of the belts that extend vertically from the first sheave 60 and the second sheave 62. This configuration allows for a horizontally aligned arrangement of the belts so that the portion of the belt 32, for example, extending vertically from the first sheave 60 is horizontally aligned with the portion of the belt 32 that extends vertically from the fourth sheave 70. The horizontal alignment in this example is parallel to a surface of the front wall 24 of the elevator car 22.

Figure 3:
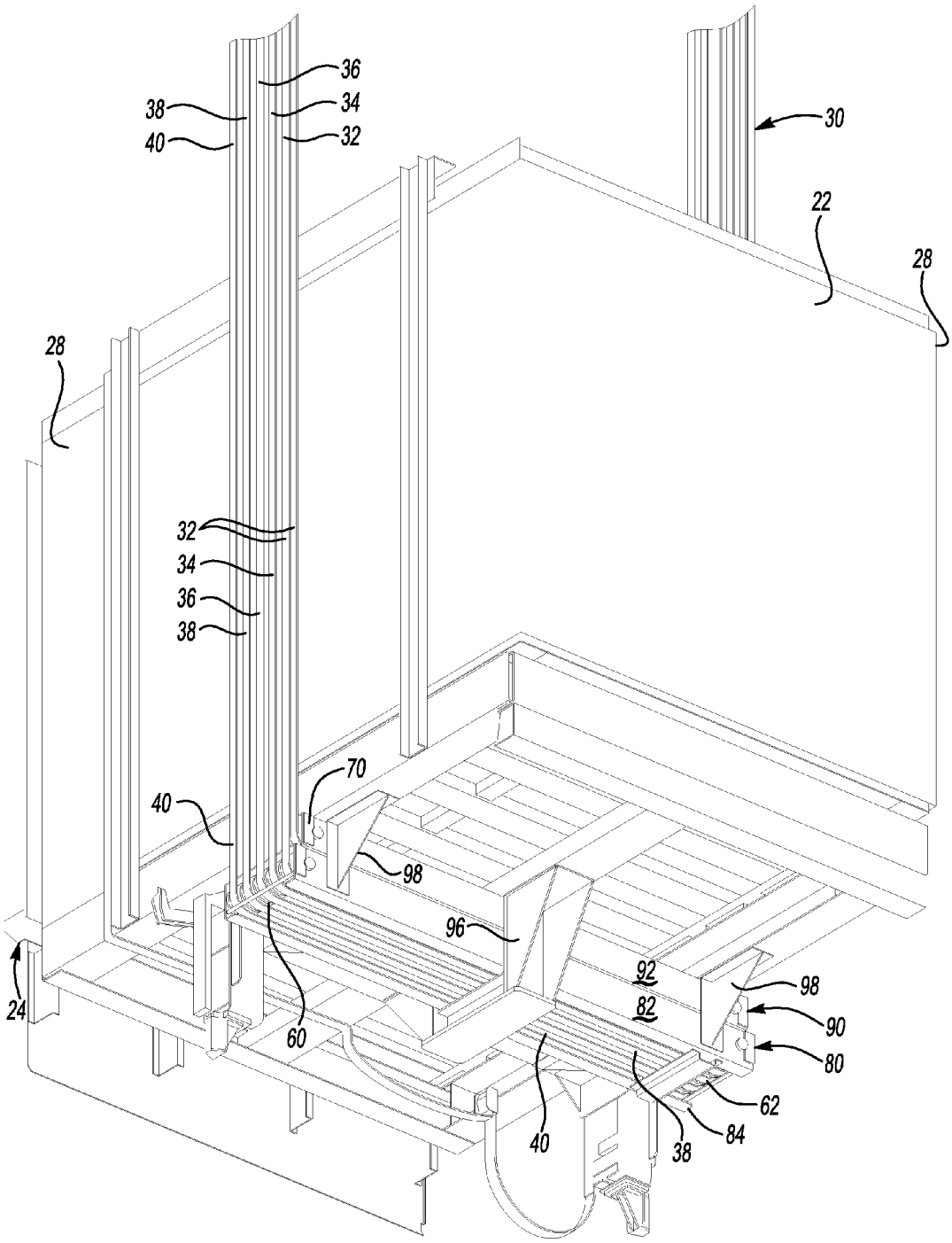
FIG. 3 diagrammatically illustrates selected features of the example of FIG. 1.
Figure 4:
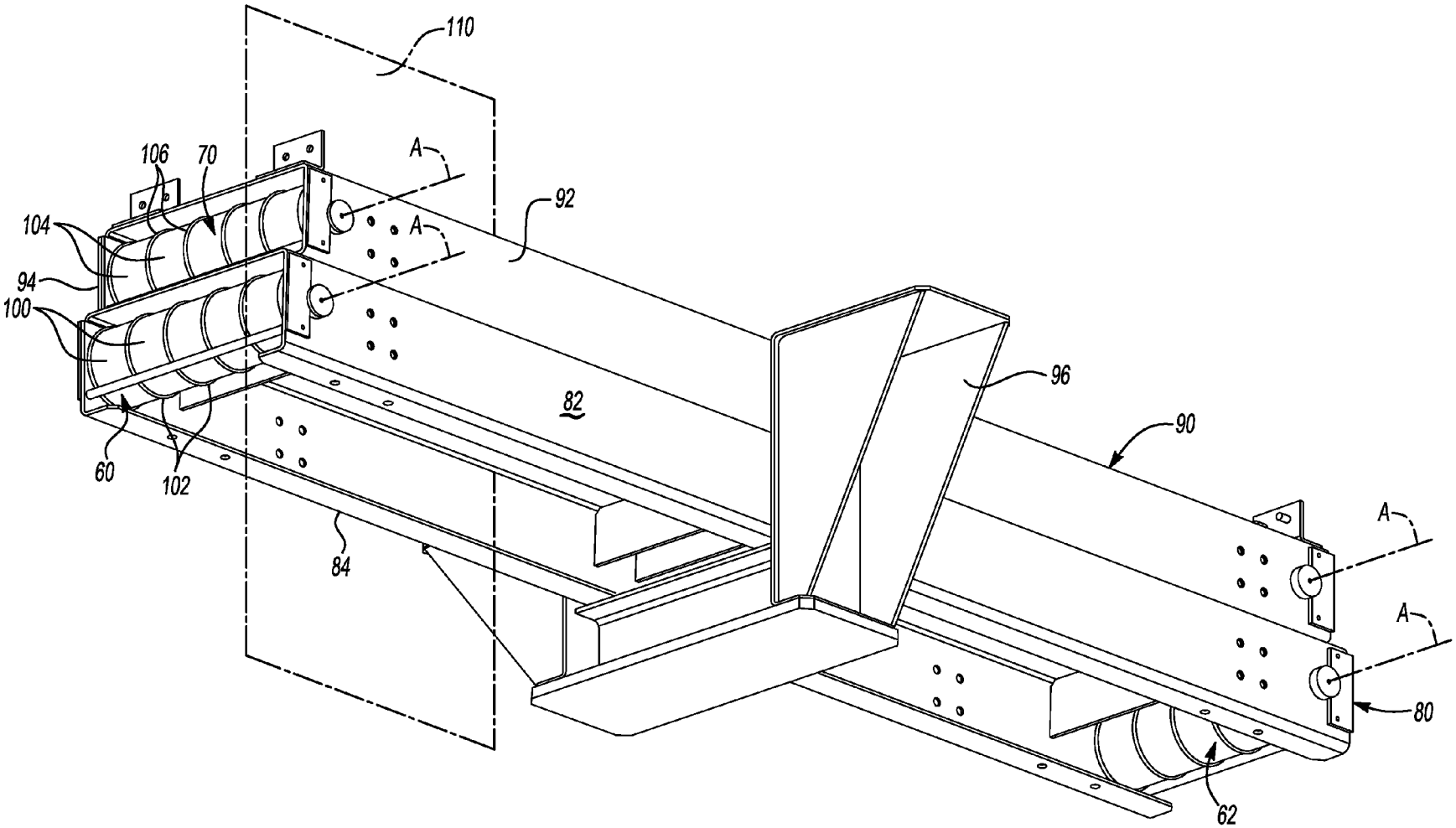
FIG. 4 diagrammatically illustrates an example configuration of cassettes and sheaves as utilized in the example of FIG. 3.

As can best be appreciated from FIGS. 3 and 4, the arrangement of the sheaves 60, 62, 68 and 70 allows for a portion of each of the belts extending between the first sheave 60 and the second sheave 62 to be vertically aligned with another portion of the same belt extending between the third sheave 68 and the fourth sheave 70.

The first sheave 60 and the second sheave 62 are supported on a cassette 80 that includes side beams 82 and 84. The first sheave 60 and the second sheave 62 are arranged with their axes of rotation A parallel to each other. The length of the cassette 80 in this example establishes the spacing $S_1$ between the first sheave 60 and the second sheave 62.

The third sheave 68 and the fourth sheave 70 are supported by a second cassette 90 that includes side beams 92 and 94. The axes of rotation A of the third sheave 68 and the fourth sheave 70 are parallel to each other and parallel to the axes A of rotation of the sheaves 60 and 62. In the illustrated example, the axis of rotation of every sheave in the elevator system 20 is parallel with the axis of rotation of every other sheave. The length of the cassette 90 in this example establishes the spacing $S_2$ between the third sheave 68 and the fourth sheave 70.

The example cassettes 80 and 90, which are fastened to each other, are secured beneath the elevator car in the example of FIG. 3 by a cassette mounting structure 96 and mounting brackets 98. In the embodiment depicted in FIGS. 3 and 4, the side beams 82, 84, 92, 94 are shown as being separate pieces that are joined together (e.g., by welding, bolting, etc.). However, in an alternate embodiment, the cassettes 80, 90 (including the side beams 82, 84, 92, 94) may be integrally formed as a single unit. In another alternate embodiment, each of the cassettes 80, 90 (including their respective side beams 82, 84, 92, 94) may be a separately, integrally formed unit; the separate integral units may then joined (e.g., by welding, bolting, etc.) when the elevator system 20 is assembled.

Vertical alignment of the portions of the belts extending between the first sheave 60 and the second sheave 62 on the one hand and between the third sheave 68 and the fourth sheave 70 on the other hand can be appreciated from FIGS. 3 and 4. Each of the sheaves includes a plurality of belt guiding surfaces that are each engaged by a corresponding one of the belts. The first sheave 60, for example, includes a plurality of belt guiding surfaces 100 with dividers 102 between adjacent belt guiding surfaces 100. The fourth sheave 70 includes a plurality of belt guiding surfaces 104. A plurality of dividers 106 are positioned between adjacent belt guiding surfaces 104. The belt guiding surfaces 100 are vertically offset with the belt guiding surfaces 104. The dividers 102 are vertically offset with the dividers 106.

The vertical positioning of the guiding surfaces 100, 104 and dividers 102, 106 in this example can be appreciated by considering the vertical plane 110 schematically shown in FIG. 4. Each of the dividers 102 is in the same vertical plane 110 as the corresponding one of the dividers 106, for example. Having the belt guiding surfaces vertically positioned in this manner and situating the sheaves 60, 62, 68 and 70 relative to each other as shown in FIGS. 3 and 4 establishes a relationship between the portions of the belt extending across the elevator car so that the belt portions are vertically aligned with each other.

In some example elevator systems, the width of each belt will be smaller than the width of the belt guiding surfaces on the sheaves. There may be some tracking of the belts along the belt guiding surfaces such that the vertical alignment of the portion of one belt extending between the sheaves 60 and 62 is not entirely coincident with the portion of the same belt extending between the sheaves 68 and 70. There is at least some vertical overlap between those two portions of the same belt because each belt is maintained between the dividers on opposite sides of the corresponding belt guiding surface. In some examples, each belt will be situated in approximately the center of the corresponding belt guiding surface and the vertically aligned portions of the belt extending across the elevator car 22 will be essentially perfectly aligned across the entire width and along the entire length of those portions of that belt. Elevator systems designed according to an embodiment of this invention will include at least some vertical alignment of the portions of each belt extending across the elevator car 22.

The vertical plane 110 can also be considered for reference regarding the vertical alignment of the portions of the belts that extend across the elevator car. For example, the edge of the belt 32 along the portion extending between the sheaves 60 and 62 may be within the vertical plane 110 along at least some of the distance between the first sheave 60 and the second sheave 62. The same edge on the portion of the belt 32 extending between the sheaves 68 and 70 may also be in the vertical plane 110 along the corresponding section of that portion.

Figure 5:
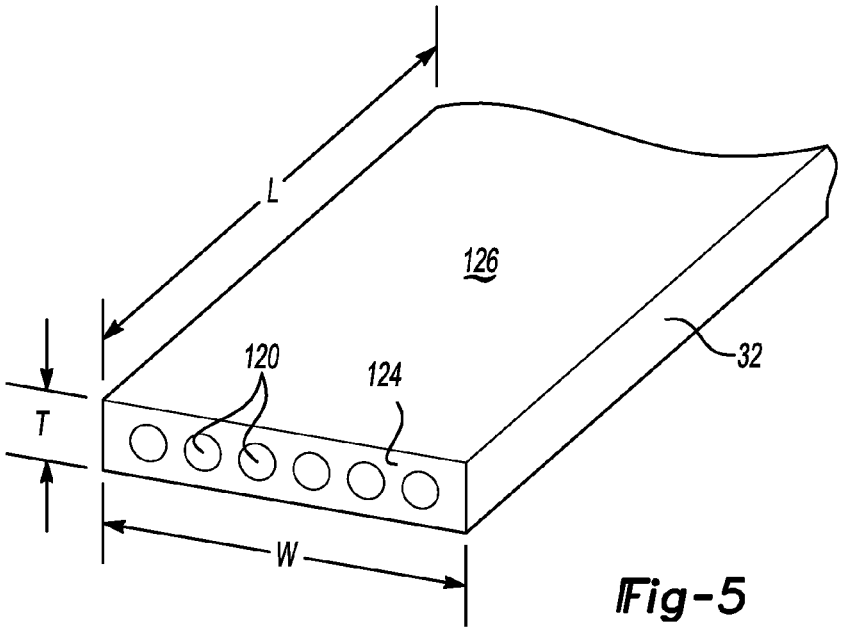
FIG. 5 schematically illustrates an example belt useful with an example embodiment of this invention.

Another feature of the example embodiments is the arrangement of the belts so that no twisting of any of the belts is required for realizing the 4:1 roping configuration. FIG. 5 schematically shows an example belt configuration that has a rectangular cross-section. A plurality of tension members 120 such as steel cords are encased within a jacket 124, which may comprise a polymer material for example. The belt 32 (as an example of the belts 32-40) has a thickness T, a width W that is larger than the thickness T and a length L that is greater than the width W. The length L extends between the terminations 50 and the terminations 72 in the example of FIG. 2.

Each belt has dual traction surfaces 126 (one of which is shown in FIG. 5) along the opposite surfaces that define the length L and width W of the belt. With the arrangement of sheaves in the illustrated example, the traction surface 126 of every belt 32-40 is aligned with the traction surface 126 of every other belt 32-40 along corresponding (i.e., similarly situated) portions of the belts. Additionally, all of the traction surfaces are always aligned parallel to a plane that is perpendicular to the front wall 24 of the elevator car 22 along the entire length of every belt. The example roping configuration does not require any twisting of any of the belts. This allows for minimizing any draw angle and facilitates better tracking of the belts along the sheaves.

Figure 6:
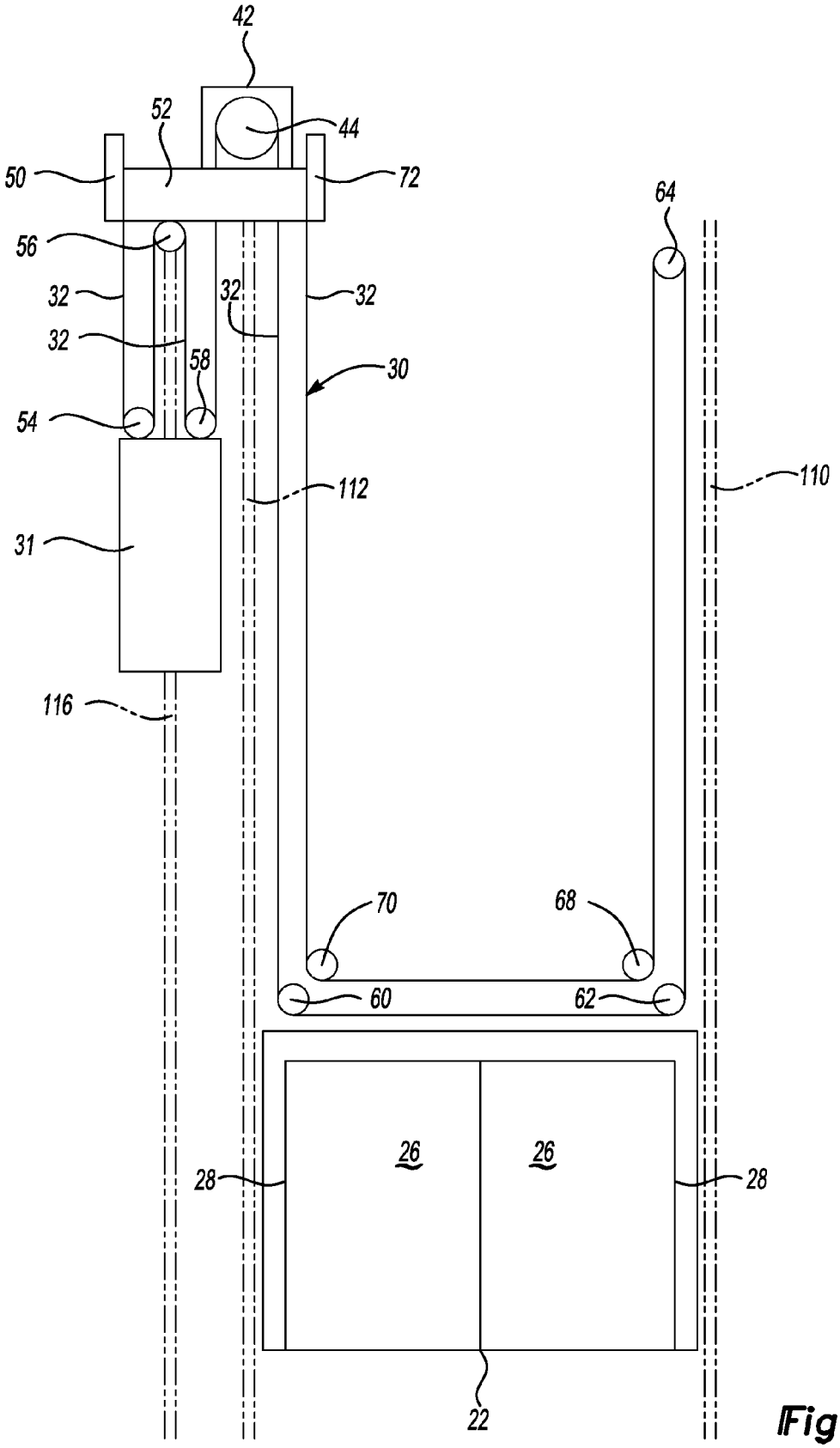
FIG. 6 schematically illustrates a path followed by belts in another example roping arrangement designed according to an embodiment of this invention.

While the example of FIGS. 1-3 includes the first sheave 60, the second sheave 62, the third sheave 68 and the fourth sheave 70 supported beneath the elevator car 22, the example of FIG. 6 includes those sheaves supported above the elevator car 22. The path followed by the belts in the example of FIG. 6 is much like that followed by the belts in the example of FIG. 2 with the exception that the portions of the belts that extend across the elevator car 22 are above the car rather than beneath the car.

The sheaves 60, 62, 68 and 70 may be supported above the elevator car 22 by maintaining the orientation of the cassette mounting structure 96 from the orientation shown in FIG. 4 and but inverting the mounting brackets 98 compared to the orientation shown in FIG. 3, for example. More specifically, if the cassettes of FIG. 4 are used in the example of FIG. 6, the first cassette 80 remains beneath the second cassette 90; however, the first sheave 60 and the second sheave 62 are closer to the elevator car 22 compared to the third sheave 68 and the fourth sheave 70. One feature of the example of FIG. 6 compared to the example of FIG. 2 is that there is more freedom for arranging the horizontal spacing $S_1$ and $S_2$ to accommodate different locations of terminations and sheaves above the elevator car 22. With the example of FIG. 2, there must be at least a minimum spacing that allows the belts to pass by the side walls 28 of the elevator car. The same requirements do not apply to the example of FIG. 6.

The illustrated examples provide a unique arrangement of sheaves for realizing a 4:1 roping arrangement in an elevator system. The illustrated examples reduce the amount of space required and provide a simpler arrangement of the belts. The various features of the illustrated examples facilitate realizing an elevator system including belts and a 4:1 roping arrangement.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator system, comprising:

an elevator car;

a plurality of belts situated relative to the elevator car such that movement of the belts for causing movement of the elevator car is approximately four times a corresponding movement of the elevator car;

a first sheave, a second sheave, a third sheave and a fourth sheave all supported for vertical movement with the elevator car and rotational movement relative to the elevator car; and wherein each belt has a portion extending across the elevator car between the first and second sheaves that is vertically aligned with another portion of the same belt extending across the elevator car between the third and fourth sheaves.

2. The elevator system of claim 1, wherein the first and second sheaves are spaced from each other a first horizontal distance; and the third and fourth sheaves are spaced from each other a second, smaller horizontal distance.

3. The elevator system of claim 2, wherein the first and second sheaves rotate about respective axes that are both in a first horizontal plane;

the third and fourth sheaves rotate about respective axes that are both in a second horizontal plane; and the first horizontal plane is beneath the second horizontal plane.

4. The elevator system of claim 1, wherein the first, second, third and fourth sheaves are all supported beneath the elevator car.

5. The elevator system of claim 1, wherein the first, second, third and fourth sheaves are all supported above the elevator car.

6. The elevator system of claim 1, comprising an idler sheave in a fixed vertical position above the elevator car and wherein the plurality of belts follow a path that includes extending downward toward the first sheave, wrapping underneath the first sheave, extending across the elevator car between the first and second sheaves, wrapping underneath the second sheave, extending upward from the second sheave, wrapping over the idler sheave, extending downward toward the third sheave, wrapping underneath the third sheave, extending across the elevator car between the third and fourth sheaves, wrapping underneath the fourth sheave and extending upward from the fourth sheave.

7. The elevator system of claim 1, wherein the elevator car has a front wall including at least one door;

each of the belts has a thickness, a width that is greater than the thickness and a length that is greater than the width;

each of the belts has a traction surface defining the width and the length of the belt;

the traction surface of every belt is aligned with the traction surface of every other belt along corresponding portions of the belts; and all of the traction surfaces are parallel with a plane that is generally perpendicular to the front wall of the elevator car along the entire length of every belt.

8. The elevator system of claim 7, wherein the elevator car includes first and second side walls that are each transverse to the front wall; and the traction surface of every belt is generally parallel to the side walls along every vertically oriented portion of every belt.

9. The elevator system of claim 1, comprising a first cassette supporting the first and second sheaves near opposite ends of the first cassette with a first horizontal spacing between the first and second sheaves;

a second cassette supporting the third and fourth sheaves near the opposite ends of the second cassette with a second, smaller horizontal spacing between the third and fourth sheaves; and wherein the first cassette is positioned beneath the second cassette.

10. The elevator system of claim 1, wherein the elevator car includes a front wall having at least one door and first and second side walls transverse to the front wall;

the first and fourth sheaves are positioned near the first side wall; and the second and third sheaves are positioned near the second side wall.

11. The elevator system of claim 10, wherein each of the sheaves includes a plurality of belt guiding surfaces;

the belt guiding surface on the first sheave engaged by a first one of the belts is vertically offset with the belt guiding surface on the third sheave engaged by the first one of the belts; and the belt guiding surface on the second sheave engaged by the first one of the belts is vertically offset with the belt guiding surface on the third sheave engaged by the first one of the belts.

12. The elevator system of claim 11, wherein the belt guiding surface for each of the belts on the first sheave is vertically offset with the corresponding belt guiding surface for the same one of the belts on the fourth sheave; and the belt guiding surface for each of the belts on the second sheave is vertically offset with the corresponding belt guiding surface for the same one of the belts on the third sheave.

13. The elevator system of claim 11, wherein each sheave includes a divider between adjacent belt guiding surfaces on the sheave; and the divider on the first sheave is vertically offset with the divider on the fourth sheave; and the divider on the second sheave is vertically offset with the divider on the third sheave.

14. The elevator system of claim 1, wherein vertically oriented portions of the belts extending upward from the first and second sheaves are horizontally spaced apart a first distance that is larger than a width of the elevator car; and vertically oriented portions of the belts extending upward from the third and fourth sheaves are horizontally spaced apart a second distance that is larger than a width of the elevator car and smaller than the first distance.

15. The elevator system of claim 1, comprising a traction sheave;

a plurality of idler sheaves; and wherein the traction sheave, the idler sheaves, the first sheave, the second sheave, the third sheave and the fourth sheave each rotate about a respective axis and all of the sheave axes are substantially parallel.

16. The elevator system of claim 15, wherein at least one of the idler sheaves is on a first side of the elevator car and the traction sheave is on a second, opposite side of the elevator car.

17. An elevator system, comprising:

an elevator car;

a plurality of belts situated relative to the elevator car such that movement of the belts for causing movement of the elevator car is approximately four times a corresponding movement of the elevator car;

a first sheave, a second sheave, a third sheave and a fourth sheave all supported for vertical movement with the elevator car and rotational movement relative to the elevator car;

a traction sheave for causing movement of the belts;

a plurality of idler sheaves;

wherein the traction sheave, the idler sheaves, the first sheave, the second sheave, the third sheave and the fourth sheave each rotate about a respective axis and all of the sheave axes are substantially parallel; and wherein each belt has a portion extending across the elevator car between the first and second sheaves that is vertically aligned with another portion of the same belt extending across the elevator car between the third and fourth sheaves.

18. The elevator system of claim 17, wherein the elevator car has a front wall including at least one door;

each of the belts has a thickness, a width that is greater than the thickness and a length that is greater than the width;

each of the belts has a traction surface defining the width and the length of the belt;

the traction surface of every belt is aligned with the traction surface of every other belt along corresponding portions of the belts; and all of the traction surfaces are substantially parallel with a plane that is generally perpendicular to the front wall of the elevator car along the entire length of every belt.

* * * * *